US005607121A

United States Patent [19]

Boriani et al.

[11] Patent Number: 5,607,121

[45] Date of Patent: Mar. 4, 1997

[54] ROLL DEPLETION MONITORING DEVICE FOR USE IN PARTICULAR WITH WRAPPING MACHINES

[75] Inventors: Silvano Boriani; Alessandro Minarelli, both of Bologna, Italy

[73] Assignee: G.D S.p.A., Bologna, Italy

[21] Appl. No.: 562,996

[22] Filed: Nov. 27, 1995

[30] Foreign Application Priority Data

Nov. 25, 1994 [IT] Italy ..... BO94A0525

[51] Int. Cl.[6] ..... B64H 26/08

[52] U.S. Cl. ..... 242/563.2; 250/559.24; 356/384

[58] Field of Search ..... 242/563.2, 563, 242/534.2, 534, 912, 333.2, 333.5, 334.5, 334, 421.2, 420.5, 419.2, 413.2; 250/559.24, 559.02, 559.26, 559.4, 559.06; 356/375, 383, 384–387; 33/733

[56] References Cited

U.S. PATENT DOCUMENTS

| | | | |
|---|---|---|---|
| 4,239,404 | 12/1980 | DeFilipps et al. | 242/563.2 |
| 4,913,366 | 4/1990 | Andou | 242/563.2 |
| 5,212,389 | 5/1993 | Wirtz | 250/559.06 |

FOREIGN PATENT DOCUMENTS

| | | | |
|---|---|---|---|
| 0155020 | 9/1985 | European Pat. Off. . | |
| 4236023 | 4/1994 | Germany | 242/563.2 |
| 58-202246 | 11/1983 | Japan | 242/563.2 |
| 1167010 | 6/1989 | Japan | 242/563.2 |
| 1145969 | 6/1989 | Japan | 242/563.2 |
| 2144362 | 6/1990 | Japan | 242/563.2 |
| 2249871 | 10/1990 | Japan | 242/563 |

*Primary Examiner*—John M. Jillions
*Attorney, Agent, or Firm*—Cushman Darby & Cushman IP Group of Pillsbury Madison & Sutro LLP

[57] ABSTRACT

The depletion of a roll strip material onto a relative core and rotatable about its own axis, typically as in wrapping machines, is monitored by a device comprising light-sensitive optoelectronic transducers associated directly with the roll, mounted pivotably in such a way as to advance gradually closer to the core in a substantially radial direction as the strip decoils; the transducers respond to the color presented by a given area of the roll, and will generate a signal on sensing a hue or shade that matches a previously selectable reference value.

5 Claims, 2 Drawing Sheets

FIG. 4
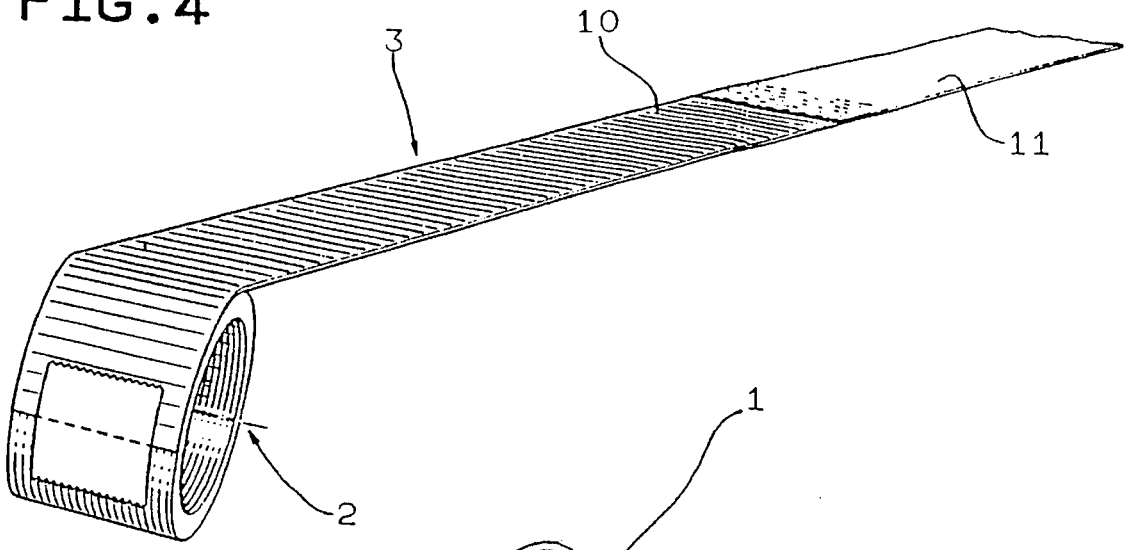
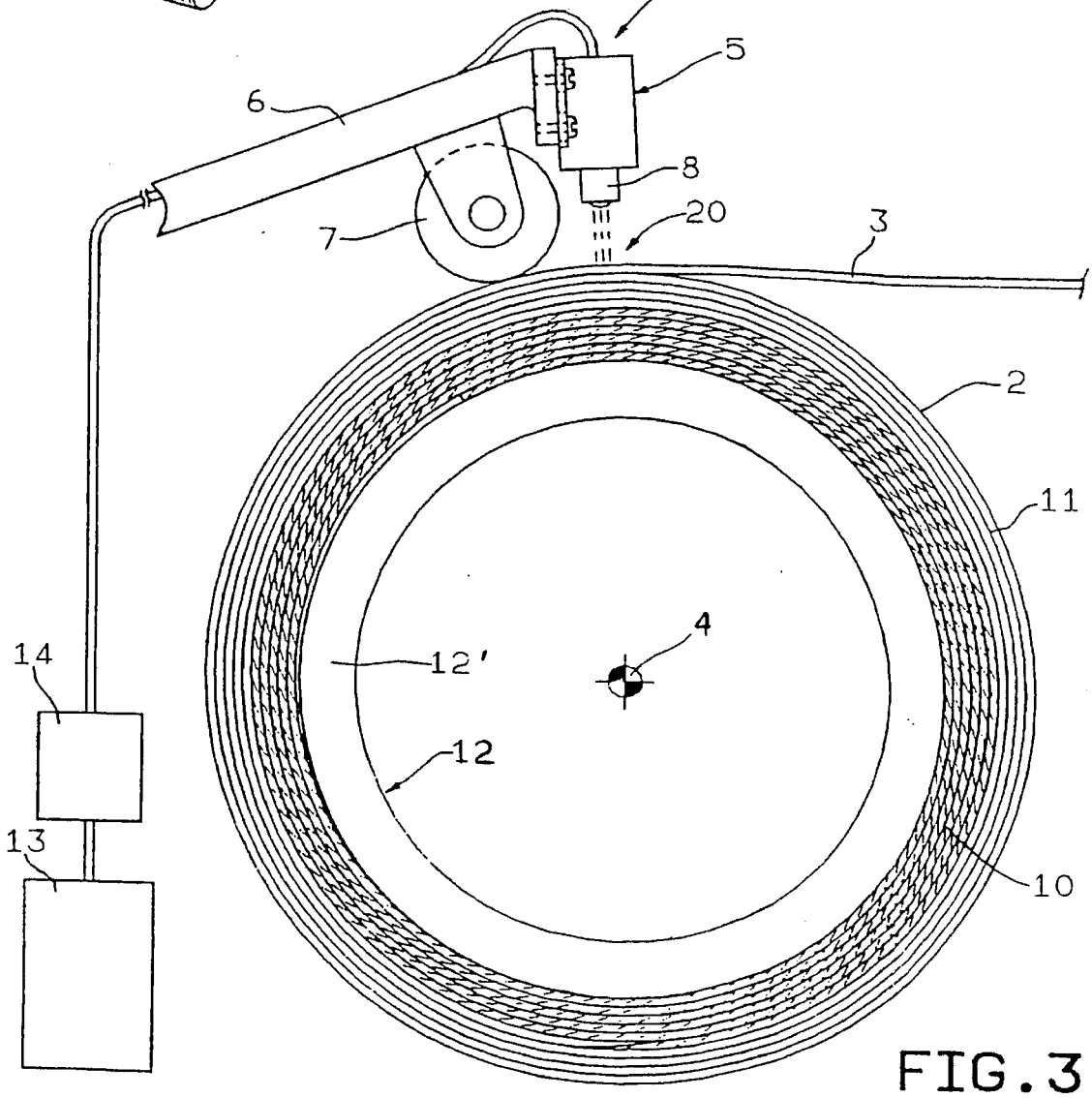
FIG. 3

ROLL DEPLETION MONITORING DEVICE FOR USE IN PARTICULAR WITH WRAPPING MACHINES

BACKGROUND OF THE INVENTION

The present invention relates to a roll depletion monitoring device, for use in particular with wrapping machines.

In particular, the present invention relates to a monitoring device such as can be utilized to sense the stage at which a decoiling roll of strip material is near to final depletion, and thereupon pilot the operation of a control unit, for example a unit that will respond by replacing the depleted roll with a new roll.

The art field of automatic wrapping machines embraces the use of devices able to detect the approaching end of a roll of strip material when nearing full depletion and indicate the condition to a control unit, by which the spent roll is then replaced with a new roll automatically.

By way of example, European Patent no 155 020 discloses a monitoring device equipped with electromagnetic transducers able to sense electric or magnetic fields generated in the vicinity of the roll decoiler bearings.

Other types of electromagnetic transducers are sensitive to variations in an electric or a magnetic field generated by way of metallic bands associated with the wrapping material, either applied to short lengths of the surface afforded by the terminal portion of the strip, or spliced on and forming the endmost coils of the roll. Roll changer units have become more effective, functional and precise in operation since transducers of this type came into use, albeit problems have also been created for manufacturers and users of the rolls of strip material in question. Whatever may be the nature of the fillet or band of metallic material adopted as a means of exciting the transducers, in effect, it must be calendered together with and form an integral part of the strip material. This gives rise to a further problem, namely, that when the wrapping material is cut and then trimmed, the resulting waste is a composite material, that is to say comprising both wrapping material and metallic material, that cannot be recovered and recycled.

The object of the present invention is to provide a device such as will detect and indicate the final depletion of a roll of strip material without any need to apply metallic indicators, be they fillets, bands, leaders or whatever, so that the roll consists entirely of a homogeneous and easily recycled material.

SUMMARY OF THE INVENTION

The stated object is realized in a device for monitoring rolls of strip material according to the present invention. Such a device is intended in particular for application to wrapping machines and comprises sensing means, associated with a single roll of material wound onto a respective core and rotatable thus about its own axis, which are capable of movement in a substantially radial direction relative to the roll as the material decoils; to advantage, the sensing means consist in light-sensitive optoelectronic transducers such as will sense the value of a chromatic characteristic presented by a predetermined area of the roll, and generate a signal when this same value of the chromatic characteristic is equal to a previously selected reference value.

BRIEF DESCRIPTION OF THE DRAWINGS

Two preferred embodiments of the invention will now be described in detail, by way of example, with the aid of the accompanying drawings, in which:

FIG. 3 illustrates a second embodiment of the device according to the present invention, in a front elevation;

FIG. 4 illustrates a roll of strip material such as can be monitored by the device of FIG. 3, viewed in perspective and in the fully depleted state.

DESCRIPTION OF THE PREFERRED EMBODIMENTS

Figure 1:
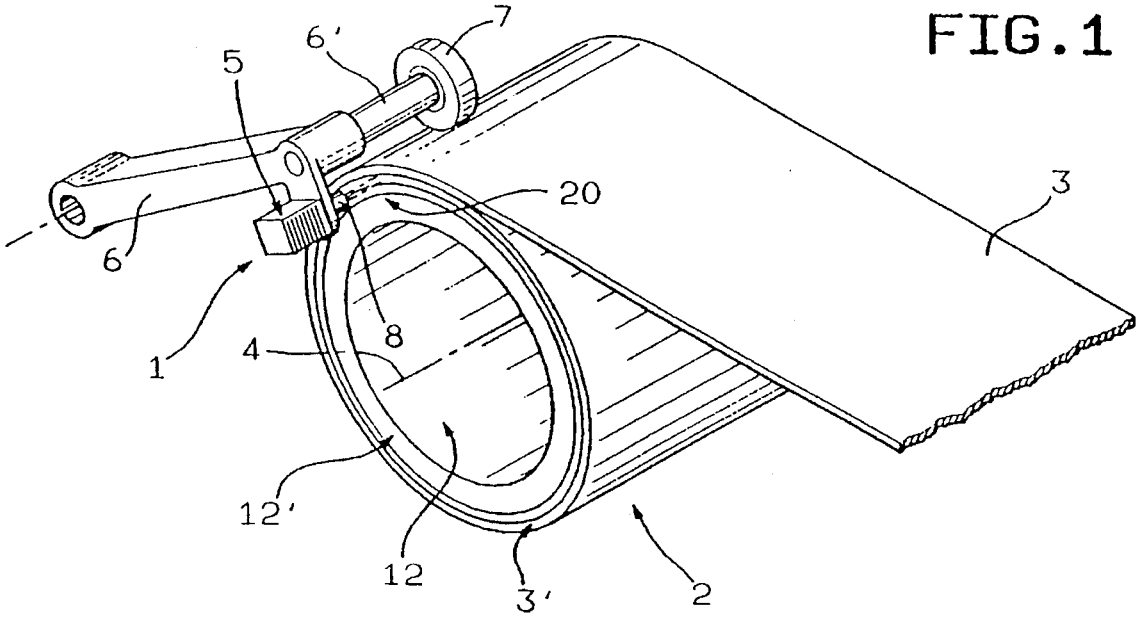
FIG. 1 illustrates a first embodiment of the device according to the present invention, viewed in perspective and with certain parts omitted.
Figure 2:
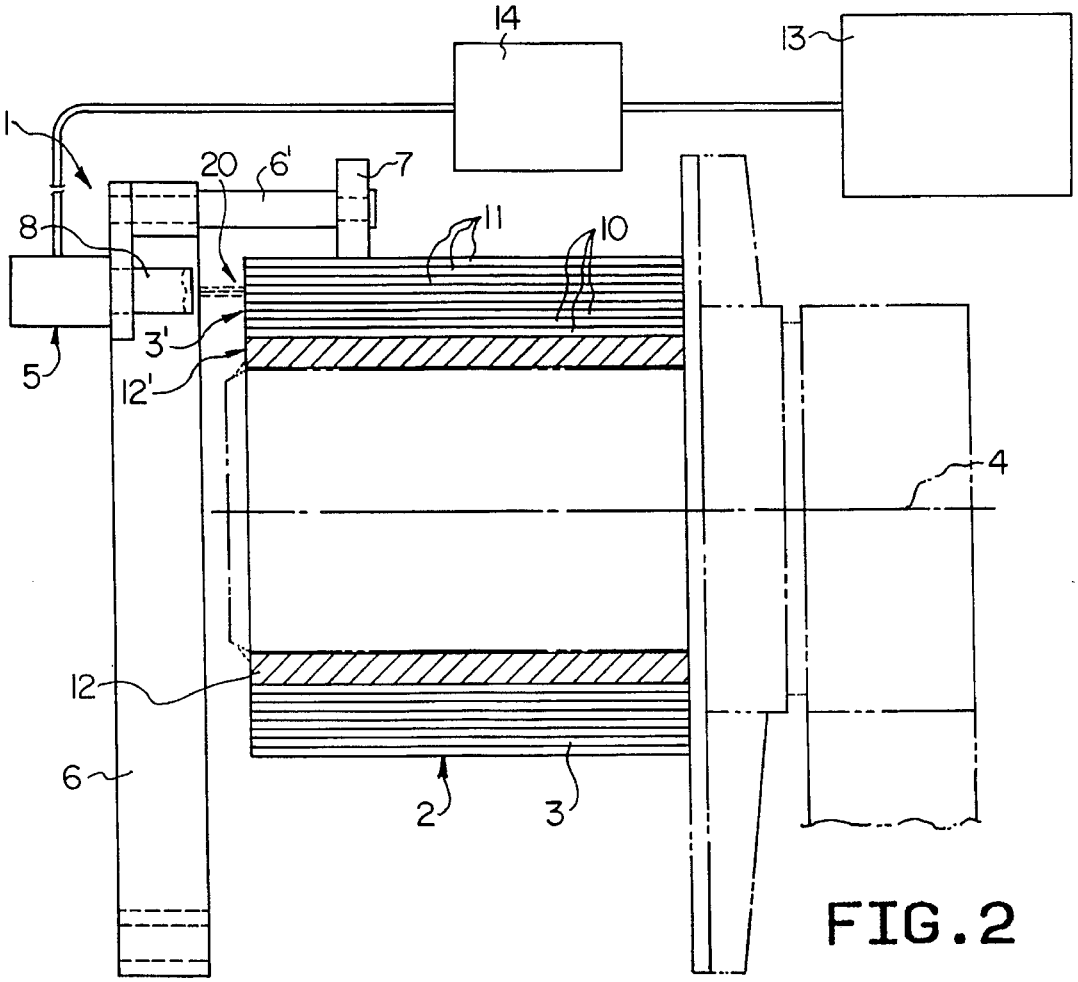
FIG. 2 illustrates the device of FIG. 1 in its entirety, in a side elevation.

With reference to FIGS. 1, 2 and 3, the present invention relates to a device, denoted 1 in its entirety, by means of which to monitor the depletion of a roll of strip material; such a device 1 is indeed installed in close proximity to a roll 2 of strip material 3.

To enable interaction with the roll 2, which rotates about its own axis of revolution 4 as the strip material 3 is decoiled, the device 1 comprises sensing means 5 carried by an arm 6. The arm 6 is supported pivotably by the frame of the wrapping machine (not illustrated in the drawings) to which the device 1 is fitted, and able thus to rotate freely about an axis lying parallel with the axis 4 of the roll 2. Given that the roll 2 is mounted typically with its axis 4 horizontally disposed, the pivoting arm 6 will be positioned on top of roll 2, its projecting end carrying a horizontal arbor 6', and at the end of the arbor, a freely revolving wheel 7 which rides on the peripheral surface of the roll 2. The wheel 7 thus remains in contact with the roll 2 by force of gravity alone.

The aforementioned sensing means 5 are light-sensitive optoelectronic transducers 8 having the capacity to measure color, their function being to interpret the value of a chromatic characteristic presented by a certain area 20 of the roll 2 which, as will become clear in due course, might consist in one or more component parts of the roll 2 itself, for example the strip material 3, a given number of single coils 10, or the core 12. The chromatic "value" referred to throughout the present specification is the intensity of the photoelectric effect, or luminous intensity, a quantity linked to the frequency of every color and its hues, which can be measured when a body of a given color is invested with radiated light. The level of the signal (usually an electrical signal) deriving from the photoelectric effect, hence proportional to the value of the chromatic characteristic in question, is processed and compared with a signal proportional to a previously selected color sample or reference value. The light-sensitive optoelectronic transducers 8 can be positioned adopting either of two different configurational and directional arrangements, as illustrated respectively in FIG. 2, where the transducing elements are oriented parallel with the rotational axis 4 of the roll 2, and in FIG. 3, along a substantially radial direction with respect to the roll 2.

A solution as in FIG. 2, with the movement of the transducer 8 occurring outside the lateral compass of the roll 2, will be eminently suitable for monitoring the depletion of any type of strip material 3 decoiling from a roll 2. In effect, a transducer 8 positioned in this manner is able to sense a chromatic characteristic presented by the strip material 3, and more exactly by the edge 3' located directly in front of the transducing element. With the roll 2 gradually decoiling, the transducer 8 draws steadily into a position of alignment with the core 12; thus, at the moment when the core 12 begins to come within the operating range of the sensing means 5, the transducer 8 will "perceive" a change in the chromatic characteristic brought about by the combination of the two different colors of the strip 3 and the core 12, and relay a signal to a control unit once the value given by this same combination matches a selected reference value. The control unit in question, indicated schematically in the drawings as a simple block 13, might be of a type such as can be piloted to replace the roll 2 automatically. The optoelectronic transducers 8 may be set up to detect and measure a particular value of the chromatic characteristic at discrete intervals, as described above, or alternatively, to measure a "variation" in the monitored value continuously and to indicate the variation over time.

In the event that the sensing means 5 comprise transducers 8 able to measure a variation in the chromatic characteristic of the predetermined area 20 continuously over time, the resulting output signal will be supplied to a comparator 14 which, on receipt of a signal proportional to a chromatic characteristic equal to the selected reference value, will in its turn relay an output signal to the control unit 13.

In this latter instance, the level of the output signal from the transducer 8 will vary in response to the variation in photoelectric effect produced by the change in the chromatic characteristic, or more simply the change in color, that occurs with the passage from the edge 3' of the strip 3 to the core 12. Accordingly, and in order to enhance the effect in question, the core 12 of the roll 2 will present a color significantly dissimilar to that of the strip material 3.

The greater the surface area of the edge 12' of the core 12 that comes within the operating range of the transducer 8, the more significant will be the variation in the level of the signal. The signal is processed and the resulting value set against a reference value by the comparator 14.

The transducer 3 as positioned in the example of FIG. 3 is well suited for operation in conjunction with transparent strip materials 3, such as heat-sealable plastics. In this particular arrangement the sensing means 5 are excited by an area 20 corresponding to the final few single coils 10 of the roll 2, which are different in color to the coils 11 used by the wrapping machine, for example dark or black as in FIG. 4.

Since the strip material 3 is transparent in this instance, the transducers 8 respond to the color of the strip 3 itself and that of the endmost coils 10 beneath, or to the rate of the change in color, which tends more and more toward that of these same coils 10 as the roll 2 nears final depletion. Once the roll 2 has been depleted to a certain point, with just a few coils 11 of useful material remaining over the final coils 10 (as illustrated in FIG. 3), the transducer 8 picks up the contrasting color of the final coils 10 through the transparent strip 3 and relays a relative signal to the control unit 13.

In the event that the transducer 8 monitors a variation in color over time, the signal is supplied to the input of the comparator 14. Likewise in this instance, the comparator 14 pilots the operation of the control unit 13, which in turn proceeds to replace the depleted roll 2 with a new roll.

What is claimed:

1. A device for monitoring depletion in rolls of strip material, suitable in particular for application to wrapping machines, comprising sensing means associated with the single roll of material wound onto a respective core and rotatable about its own axis, means mounting the sensing means for movement in a substantially radial direction relative to the roll as the material decoils, said sensing means includes light-sensitive optoelectronic transducers such as will sense the value of a chromatic characteristic presented by a predetermined area of the roll and means for generating a signal when this same value of the chromatic characteristic is equal to a previously selected reference value.

2. A device as in claim 1, wherein the light-sensitive optoelectronic transducers are oriented in a direction substantially parallel to the axis of rotation of the respective roll, occupying a position such that their movement occurs outside the lateral compass of the roll, and the predetermined area is afforded by the edge of the coils of strip material facing the transducers.

3. A device as in claim 1, wherein the light-sensitive optoelectronic transducers are oriented in a direction substantially parallel to the axis of rotation of the respective roll, occupying a position such that their movement occurs outside the lateral compass of the roll, and the predetermined area is afforded by the edge of the core facing the transducers.

4. A device as in claim 1, in particular for monitoring rolls of transparent strip material, wherein the light-sensitive optoelectronic transducers are oriented in a substantially radial direction relative to the respective roll, occupying a position such that their movement occurs within the lateral compass of the roll, the predetermined area is afforded by the final coils of strip material, and the color of the final coils is different to that of the remaining transparent strip material.

5. A device as in claim 1, in particular for monitoring rolls of transparent strip material, wherein the light-sensitive optoelectronic transducers are oriented in a substantially radial direction relative to the respective roll, occupying a position such that their movement occurs within the lateral compass of the roll, the predetermined area is afforded by the core about which the final coils of strip material are wound, and the color of the core is different to that of the remaining transparent strip material.

* * * * *